US006212934B1

(12) United States Patent
Tseng

(10) Patent No.: US 6,212,934 B1
(45) Date of Patent: Apr. 10, 2001

(54) RECOVERABLE AND REUSABLE COLD FORGING DIES

(76) Inventor: Shao-Chien Tseng, No. 130 Sec. 2 Yang-Shin Rd., Yang-Mei Taoyuan 326 (TW)

( * ) Notice: Subject to any disclaimer, the term of this patent is extended or adjusted under 35 U.S.C. 154(b) by 0 days.

(21) Appl. No.: 09/399,928

(22) Filed: Sep. 21, 1999

Related U.S. Application Data

(63) Continuation-in-part of application No. 09/061,010, filed on Apr. 15, 1998, now abandoned.

(51) Int. Cl.[7] ..... B21D 37/01
(52) U.S. Cl. ..... 72/462; 76/107.1
(58) Field of Search ..... 72/462; 76/107.1, 76/107.4

(56) References Cited

U.S. PATENT DOCUMENTS 2,593,571 * 4/1952 Klemach ..... 72/342.3
3,088,174 * 5/1963 Kolt ..... 76/107.1
5,081,861 * 1/1992 Miura ..... 72/462

FOREIGN PATENT DOCUMENTS

2669842 * 6/1992 (FR) ..... 72/462
62-176620 * 8/1987 (JP) ..... 72/462
5-154580 * 6/1993 (JP) ..... 72/462

* cited by examiner

*Primary Examiner*—Ed Tolan
(74) *Attorney, Agent, or Firm*—Pro-Techtor International Services

(57) ABSTRACT

An improved recoverable and reusable die used for cold forging utilizing a medium of penetration made of an alloy with a low melting point. The alloy is a mixture of the elements Bi, Pb, and Sn. The alloy is poured into the basic die structure, and is solidified at a normal temperature to be a medium of solidifying for the basic die structure. Since the alloy with a low melting point is molten at a low temperature, all the members in the basic die structure are recoverable for reusing. Thus the shapes of the die cavities of the workpieces to be forged can be repeatedly changed and the cost of production of cold forging dies is lowered.

4 Claims, 4 Drawing Sheets

RECOVERABLE AND REUSABLE COLD FORGING DIES

This is a continuation-in-part application of applicant's patent application Ser. No. 09/061,010 filed on Apr. 15, 1998 now abandoned.

BACKGROUND OF THE INVENTION

1. Field of the Invention

The present invention relates to an improved recoverable and reusable die used for cold forging. The die provides a high number of uses for cold forging under a normal temperature. The plastic film on the frame of the die is taken off when changing the shape of the die cavity. An alloy with a low melting point is used so that the die cavity can be softened and a new plastic film can be used to form a die cavity with a new shape. The die is re-solidified to be suitable for cold forging. In this way, a die can be recovered and reused.

2. Description of the Prior Art

The basic structure of a die for cold forging as disclosed in the present invention is described in U.S. Pat. No. 5,727,420. The structure includes a die frame formed from metallic material, a bottom lid with bolt holes, a suitable number of strut spacers welded on the bottom lid, a plastic film provided on top of the die frame, an upper filler layer and a lower filler layer lapped with each other in the die frame, and a suitable amount of steel beads (or iron pellets). The plastic film is shaped to conform to the shape of a die cavity formed by a vacuum forming technique using PET or PVC plastic material. The upper filler layer is formed by overlapping a plurality of sheets made of material such as Kevlar. The lower filler layer is formed by several sheets of stainless steel mesh.

In manufacturing the die, the upper and the lower filler layers are placed below the plastic film in the die frame. Then liquid mercury is poured into the die as a medium of penetration in the basic die structure. The liquid mercury penetrates the gaps formed by the mesh of the stainless steel nets and small holes on the sheets of Kevlar. After a fast freezing operation, the liquid mercury in the die is frozen to solidify the basic die structure and becomes a solidifying medium in the basic die structure.

The prior art takes advantage of the physical characteristic of mercury which is solidified at −38.5° C., so that the liquid mercury is poured into the die as a medium of penetration in the basic die structure under a normal temperature, and the die is fast frozen to −40° C. with chilling equipment. The mercury thus expands during solidification to support the basic die structure.

However, in the stated prior art, expensive mercury is chosen as a medium of penetration in the basic die structure. Although mercury provides the advantage of repeated and recoverable use of the fillers for the die, higher cost is required for manufacturing the die. The temperature of the die must be lowered to be below −40° C., which requires expensive chilling equipment.

SUMMARY OF THE INVENTION

In view of this, it is the motive of the present invention to choose material which does not need freezing equipment and is cheaper than mercury as a medium of penetration during formation of the basic structure of the die.

The main object of the present invention is to provide an alloy with a low melting point to be used as a medium of penetration and solidifying into the basic structure of the cold forging die. The alloy must change from solid state to liquid state at a low melting temperature.

To achieve the above stated object, it is necessary to maintain the basic structure of the die comprising the die frame, the bottom lid, the strut spacers, the plastic film, the upper filler layer and the lower filler layer.

Moreover, it is also a key technical point to apply a refractory heat insulating layer (such as SK32) on the inner wall of the plastic film having a lower melting point than the basic die structure, so that the plastic film will not melt when the molten alloy with a low melting point is poured into the basic die structure.

Further, the alloy with a low melting point is made by mixing Bi, Pb, and Sn which are inexpensive materials. When the alloy is used in the basic die structure as a medium of penetration, the die manufacturing cost is greatly reduced. This allows the cold forging die to have the advantage of being recoverable and reusable as well as capable of repeated changing of the shape of its die cavity.

The present invention will be apparent after reading the detailed description of the preferred embodiment thereof with reference to the accompanying drawings.

DETAILED DESCRIPTION OF THE PREFERRED EMBODIMENT

Figure 1:
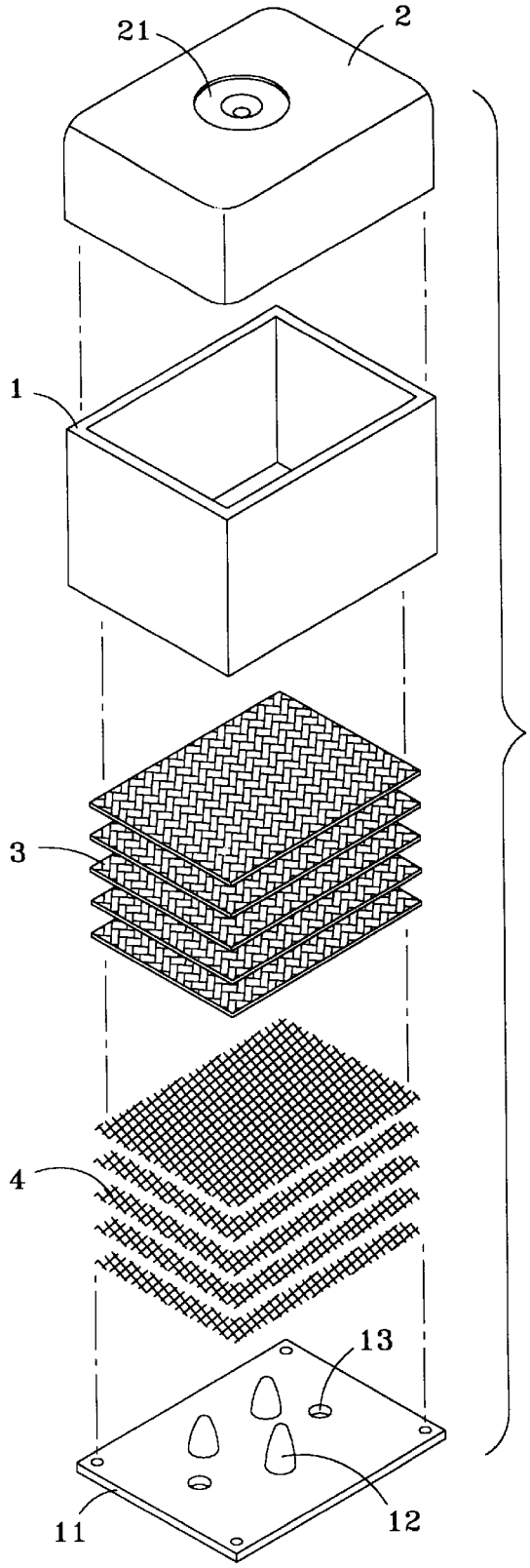
FIG. 1 is an exploded perspective view of the basic die structure of the present invention.

As shown in FIG. 1, in the improved recoverable and reusable die used for cold forging of the present invention, the basic die structure includes a die frame 1, a bottom lid 11, a plurality of strut spacers 12 welded to the bottom lid 11, a plastic film 2 provided on the top of the die frame 1, an upper filler layer 3 and a lower filler layer 4 lapped in the die frame 1, and a suitable amount of steel beads (or iron pellets) 51 that are poured into die frame 1 after mixing with a liquid medium of penetration.

The plastic film 2 is made of PET or PVC plastic material and has a die cavity 21 in the shape desired for the workpiece to be forged. The upper filler layer 3 is formed by overlapping of the soft sheets made of material such as Kevlar. The lower filler layer 4 is formed by several sheets of plasticized stainless steel mesh.

Figure 2:
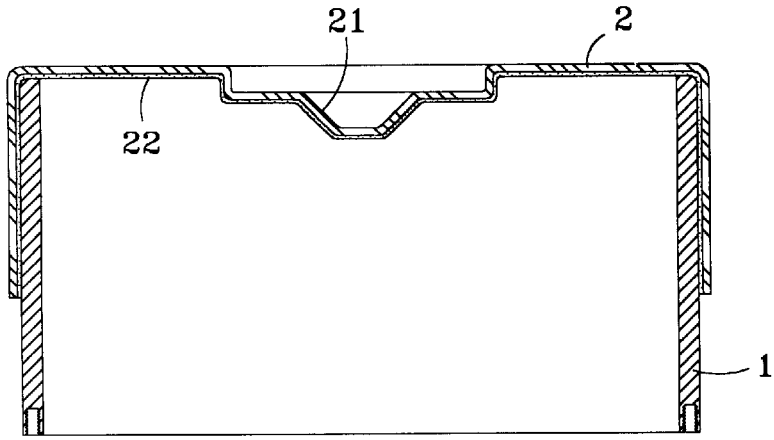
FIG. 2 is a sectional view of the plastic film on the die frame of the present invention.

When manufacturing the die with the above stated members, a refractory heat insulating layer (such as SK32) is applied on the inner wall of the plastic film 2 which covers the top of the die frame 1. The plastic film 2 is thereby rendered non-melting under high temperatures (as shown in FIG. 2).

Figure 3:
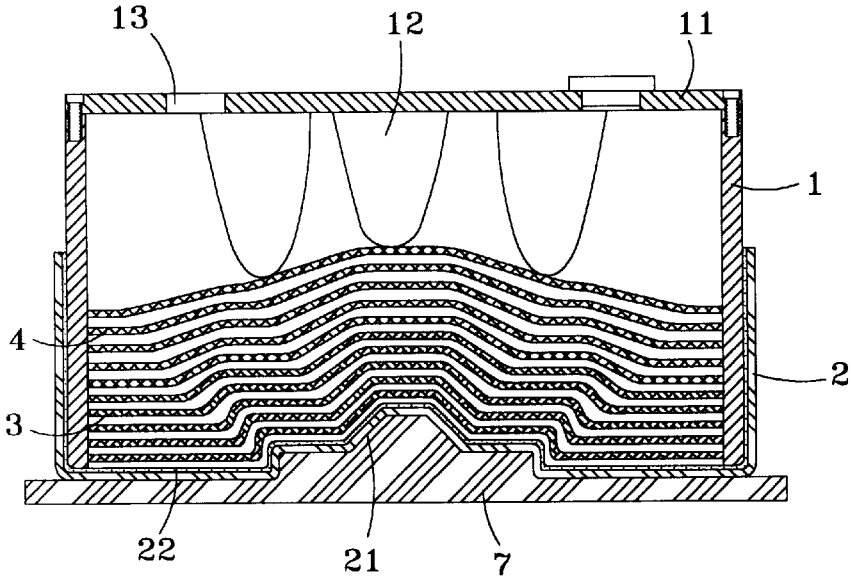
FIG. 3 is a sectional view showing the basic die structure of the present invention turned upside down.

Before turning the die frame 1 upside down, a male die 7 made of industrial plastic and conforming in shape with the cavity 21 is placed in the cavity 21 to temporarily support the plastic film 2. Then the upper filler layer 3 is formed by overlapping soft sheets made of material such as Kevlar. Then the lower filler layer 4 is formed from several sheets of stainless steel mesh placed in the die frame 1. The metallic strut spacers 12 welded to the bottom lid 11 (now at the top of the assembly) are provided to brace the upper and lower fillers 3, 4. The basic die structure for the cold forging die is then completed (as shown in FIG. 3).

Thereafter, a molten medium of penetration mixture comprising an alloy 8 with a low melting point is poured into the basic die structure of the cold forging die. The alloy 8 with a low melting point is formed by melting together the elements Bi, Pb and Sn in predetermined weight ratios. The weight ratios control the melting point of the alloy. When the Bi, Pb, and Sn are mixed in the weight ratio of 8:5:3, the melting point of the alloy is about 80° C. When the Bi, Pb, and Sn are mixed in the weight ratio of 2:1:1, the melting point of the alloy is about 93° C. When the Bi, Pb and Sn are mixed in the weight ratio of 5:2:3, the melting point of the alloy is about 100° C.

Therefore, the melting point of the alloy 8 is lower than that of the component in the die. These components include the alloy steel (such as the carbon steel in S45C) forming the bottom lid 11 and the steel beads 51, the manganese steel forming the metallic strut spacers 12, the Kevlar fibers, the stainless steel mesh, the iron pellets, and after a refractory heat insulating layer 22 (such as SK32) is applied, the plastic film 2. Therefore, once the basic die structure of the cold forging die is filled with the alloy 8 with a low melting point, all the materials of the members in the basic die structure have higher melting temperatures than that of the poured alloy 8.

Figure 4:
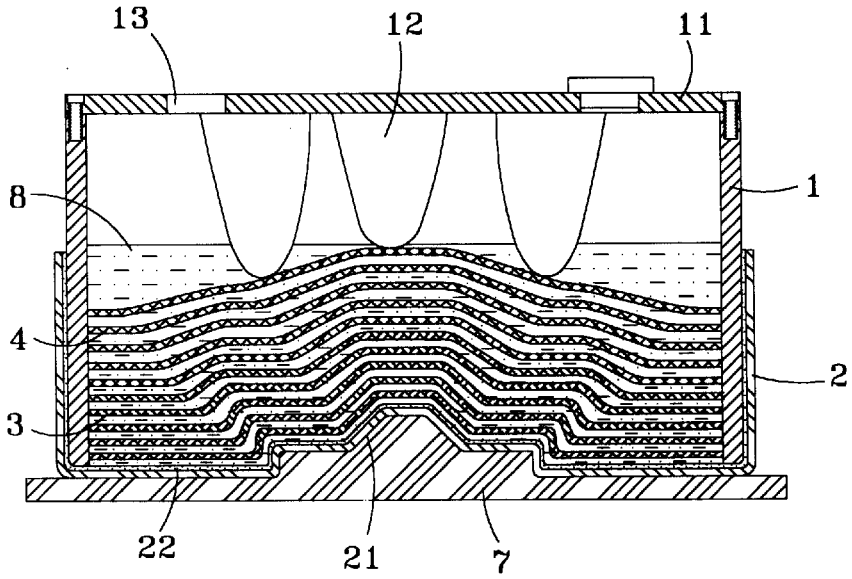
FIG. 4 is a sectional view showing the pouring of the medium of penetration into the die.

As is shown in FIG. 4, the alloy 8 with a low melting point is poured into the die frame 1. The alloy 8 is in a molten state and has a high specific weight so that it penetrates the stainless steel mesh in the lower filler layer 4 and the holes in the cloth sheets in the upper filler layer 3. The alloy 8 is poured into the die until the woven holes and the mesh holes in the upper and lower filler layers 3,4 and the gaps among the filler layers and the plastic film 2 are fully covered by filled the alloy 8.

Figure 5:
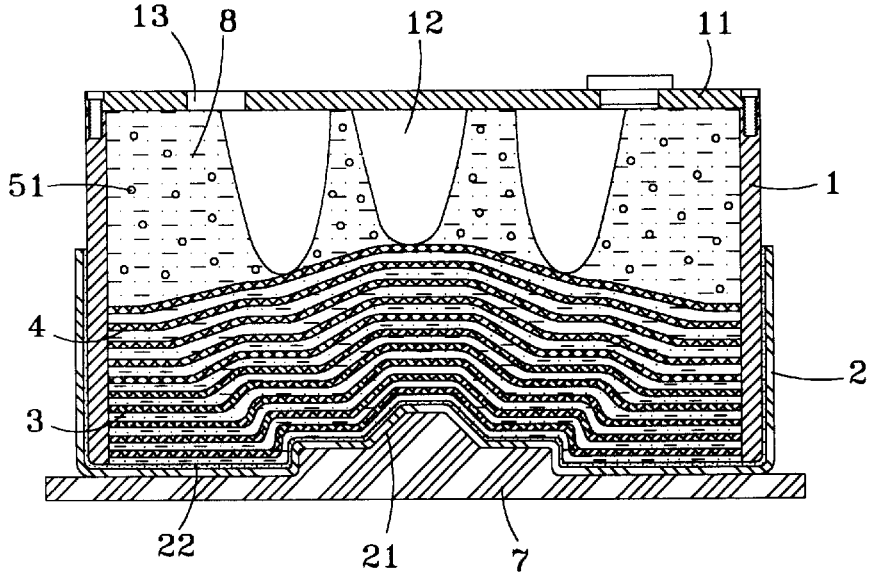
FIG. 5 is a sectional view showing the filling of the die with the alloy with a low melting point and a suitable amount of steel pellets.

Before filling in the space between the metallic strut spacers 12 and the bottom lid 11 in the die frame 1, a suitable amount of steel beads (or iron pellets) 51 are uniformly mixed into the molten alloy 8 with a low melting point. The molten alloy 8 mixed with the steel beads (or iron pellets) 51 is then poured into the die frame 1 until the die frame 1 is completely filled (as shown in FIG. 5).

Figure 6:
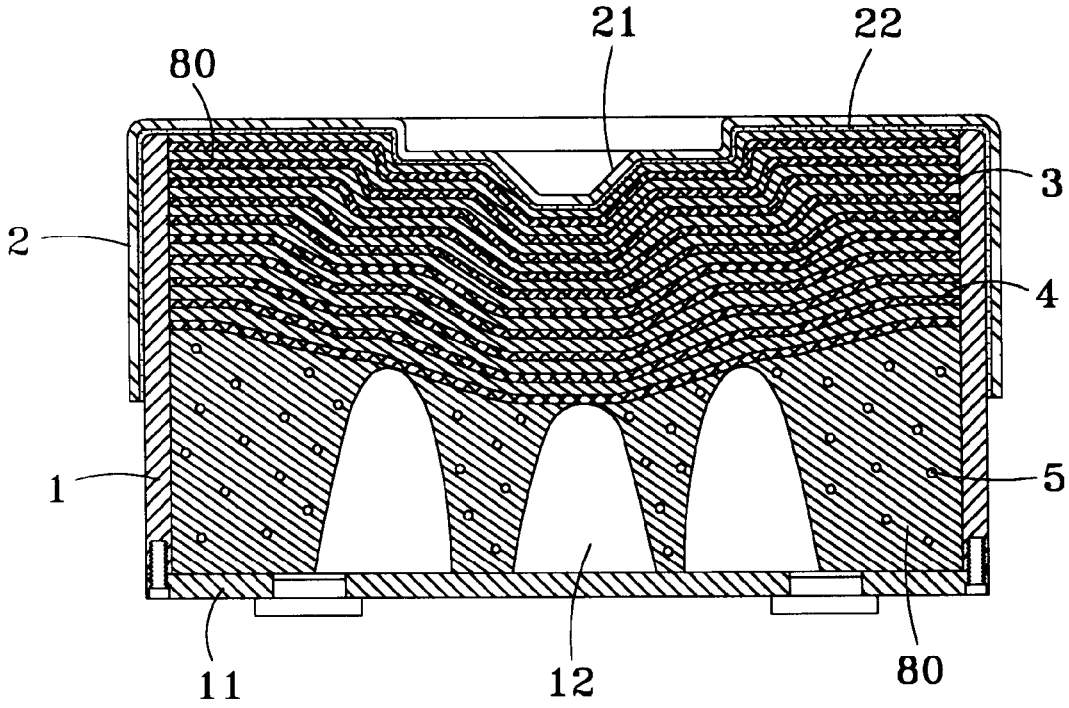
FIG. 6 is a sectional view showing a finished article in the cold forging die of the present invention.

When the alloy 8 loaded into the die frame 1 is cooled and solidified, it supports all the members in the basic die structure. The die frame 1 is then turned over to stand upright, and the article of the cold forging die is formed (as shown in FIG. 6).

The present invention can increase and decrease the strength of the die by increasing and decreasing the number of layers of the upper and lower filler layers 3,4 or by increasing and decreasing the amount of the steel beads (or iron pellets) 51. When a different workpiece is required, the die does not have to be changed, rather, the old plastic film 2 is removed from the die frame 1 and heat is applied to the alloy 8. The alloy 8 is gradually liquified so that the shaped die cavity can be changed. A new plastic film 2 is installed, and the alloy 8 is again solidified to strengthen the basic die structure with a new die cavity. The old plastic film 2 can be reused by applying a refractory heat insulating layer 22, so that all the members in the basic die structure are recoverable and reusable. Moreover, so long as the die is operated under a normal temperature for the process of cold forging, there is no necessity for other peripheral equipment for freezing.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What is claimed is:

1. A method of cold forging with a reusable die comprising the following steps:

a) forming a basic die structure comprising a die frame, a bottom lid, a plurality of strut spacers affixed to said bottom lid, a plastic film with a refractory heat insulating layer positioned on the top of said die frame and conforming in shape to a shape of a workpiece to be formed, an upper filler layer formed from a plurality of flexible sheets, and a lower filler layer formed from a plurality of sheets of steel mesh, said upper filler layer and said lower filler layer are contained in a die cavity of said die frame, b) forming a medium of penetration from an alloy with a low melting point, said alloy is poured in liquified form into said die frame, said liquified alloy penetrating and filling pores in said upper filler layer and said lower filler layer, c) cooling said alloy so that said alloy is solidified, said alloy thereby encapsulating said upper filler layer and said lower filler layer, d) cold forging a workpiece into a desired shape in said reusable die, and e) melting and recovering said alloy so that said alloy can be used to form a new die.

2. The recoverable and reusable die used for cold forging as defined in claim 1, wherein:

metallic particles are mixed with said alloy.

3. The recoverable and reusable die used for cold forging as defined in claim 2, wherein:

a supporting strength of said alloy in said reusable die is controlled by varying a concentration of said metallic particles.

4. The recoverable and reusable die used for cold forging as defined in claim 1, wherein:

said alloy comprises Bi, Pb, and Sn.

* * * * *